United States Patent [19]

Groot et al.

[11] 4,160,935

[45] Jul. 10, 1979

[54] METHOD AND APPARATUS FOR PROVIDING REFERENCE POINTS FOR MOUNTING THE MAGNETIC DEFLECTION UNIT OF A COLOR DISPLAY TUBE

[75] Inventors: Theodorus C. Groot; Pieter Huijer; Johannes G. van Lent, all of Eindhoven, Netherlands

[73] Assignee: U.S. Philips Corporation, New York, N.Y.

[21] Appl. No.: 831,334

[22] Filed: Sep. 7, 1977

[30] Foreign Application Priority Data

Sep. 17, 1976 [NL] Netherlands ..... 7610353

[51] Int. Cl.[2] ..... H01J 29/56

[52] U.S. Cl. ..... 315/370; 313/425; 315/10

[58] Field of Search ..... 335/212; 313/425, 440, 313/413; 315/370, 10

[56] References Cited

U.S. PATENT DOCUMENTS

| | | | |
|---|---|---|---|
| 3,605,053 | 9/1971 | Anthony | 335/212 |
| 3,934,169 | 1/1976 | Groothoff et al. | 313/425 |

FOREIGN PATENT DOCUMENTS

| | | | |
|---|---|---|---|
| 2459190 | 8/1975 | Fed. Rep. of Germany | 335/212 |

*Primary Examiner*—Maynard R. Wilbur
*Assistant Examiner*—Richard E. Berger
*Attorney, Agent, or Firm*—Algy Tamoshunas

[57] ABSTRACT

The position of the electron beam axis of the central gun of an in-line tube is determined by moving the tube relative to a dynamic, multipole magnetic field produced by an electro-magnet mounted about the tube neck until a dot is displayed on the display screen. The line passing through the center of the field and the dot on the display screen defines the position of the beam axis and reference points related to that line are then provided on the tube envelope which locate the deflection unit so that its axis coincides with the beam axis.

9 Claims, 4 Drawing Figures

Figure 1:
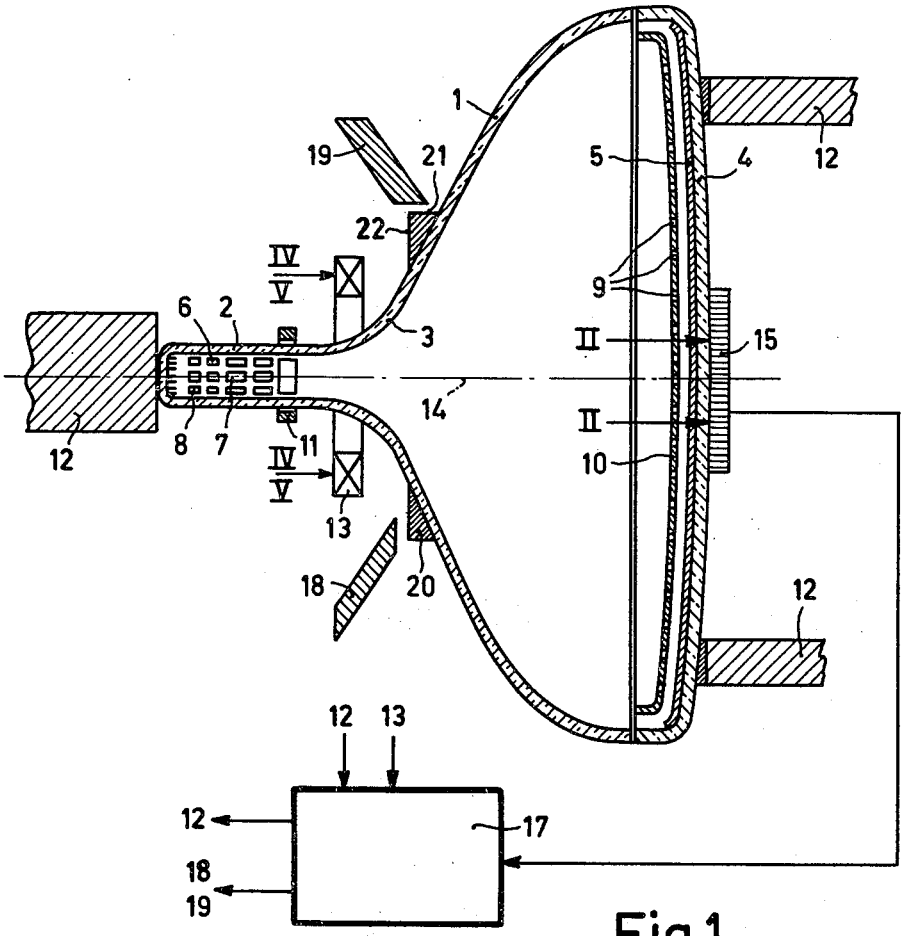

METHOD AND APPARATUS FOR PROVIDING REFERENCE POINTS FOR MOUNTING THE MAGNETIC DEFLECTION UNIT OF A COLOR DISPLAY TUBE

The invention relates to a method of adjusting and providing reference points for the magnetic deflection unit which in the operating condition is mounted about the neck and the funnel-shaped part of the envelope of an in-line colour display tube. In such a tube, the three electron guns are mounted in the tube neck with their axes in a common plane and the display screen is located at the end of the tube opposite the electron guns.

The invention also relates to a display tube provided with reference points according to the method, a device for carrying out the method, and a display tube manufactured by means of the device.

Such a method is known from Netherlands Pat. application No. 7,500,853 laid open to public inspection in which it is disclosed that in the display tube factory reference points are provided on the neck and/or the funnel-like portion of the envelope by means of a standard deflection unit. The standard deflection unit is a deflection unit whose deflection properties are accurately determined, for example, with Hall probe measurements. Such an envelope should then be combined with a deflection unit which is also provided with reference points on a standard display tube. The drawback of this method is that the adjustment of the deflection units is related to the adjustment of a standard deflection unit and not to the location and the direction of an electron beam. Large inaccuracies may occur due to asymmetry in the deflection unit and/or due to the not entirely correct positioning of the electron guns in the neck during sealing. It is therefore the object of the invention to provide a method without these drawbacks in which the adjustment of the deflection unit by means of reference points on the envelope is determined by the position and direction of the axis of the electron beam produced by the central electron gun.

According to the invention, a method of the kind mentioned in the first paragraph is characterized in that the electron beam of the central electron gun is adjusted to produce on the display screen a colour-pure display by means of a colour purity magnet. A dynamic magnetic multipole field is then generated in a plane substantially normal to the longitudinal axis of the colour display tube around the neck of the colour display tube near the electron gun. Thereafter, the colour display tube is tilted and moved relative to the dynamic multipole field substantially in the plane normal to the axis of the colour display tube until a dot is obtained on the display screen. The reference points are then provided on the neck of the tube and/or the funnel-shaped part of the envelope which locate the position and the direction of the electron beam axis of the central electron gun which are determined by the line joining the center of the multipole field and the dot on the display screen.

The great advantage of this method is that the reference points locate the position and the direction of the electron beam axis of the central gun of the tube. As a result it is possible to adjust an accurately manufactured deflection unit by moving it against the reference points. As a result, the electron optical axis of the deflection unit coincides with the electron beam axis of the central gun. For less accurately manufactured deflection units a small correction will be sufficient to cause the axes to coincide.

The magnetic multipole is preferably a dynamic magnetic four-pole field.

A device for carrying out the method according to the invention comprises a holder for the colour display tube with which it can be tilted and moved substantially in the plane normal to the tube axis, a dynamic multipole magnet which can be placed around the neck of the colour display tube, an instrument for observing and localizing the dot on the display screen, and means for adjusting the reference points.

The instrument for localizing the point on the display screen may be a simple monocular. Alternatively, it is also possible to use a matrix of photosensitive elements such as photodiodes for this purpose. As a matter of fact, such a matrix can be connected to a process computer which controls the movement of the holder for the colour display tube and/or the means for adjusting the reference points. The reference points may be adjusted in a number of different ways. It is possible, for example, to provide the reference points by spraying or pouring a quantity of thermoplastic material or a material with a hardener between a deflection unit and the tube neck and/or cone. In that case, the means comprise a spraying or pouring device.

Another possibility is to provide a ring or a number of thickenings around the neck and/or the funnel-shaped portion of the envelope which are ground by means of a cutting device dependent on the direction and position of the electron beams.

By means of such spraying or pouring device or cutting device, the position of the deflection unit in the direction of the axis of the colour display tube which also determines the colour purity can simultaneously be fixed.

Figure 2:
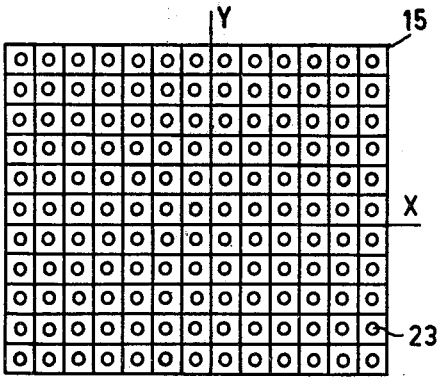
Figure 3:
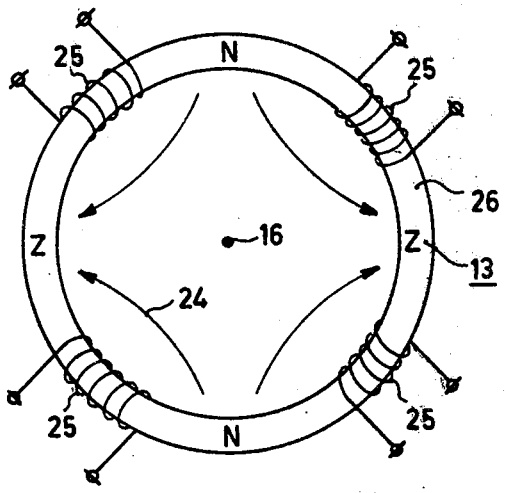
Figure 4:
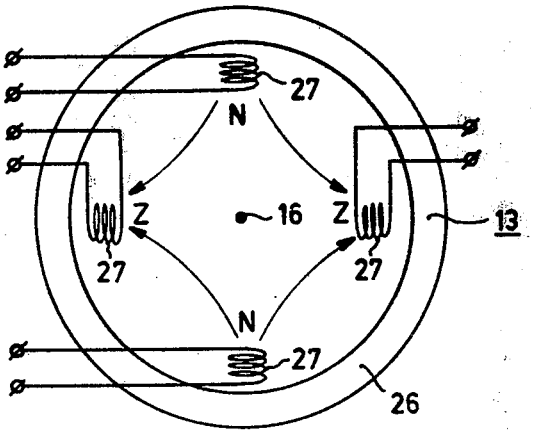

The invention will now be described in greater detail with reference to a drawing, in which FIG. 1 explains the method, FIG. 2 shows a matrix of photosensitive elements, and FIGS. 3 and 4 show a few possible fourpoles.

FIG. 1 is a sectional view of a colour display tube. The glass envelope 1 has a neck 2, a funnel-shaped portion 3 and a display window 4. On the inside of the display window 4 is a display screen 5 which, in a colour display tube of the "in-line" type, usually consists of a large number of triplets of stripe-shaped phosphor regions. Mounted in the neck 2 of the envelope are three electron guns 6, 7 and 8 with their axes disposed in a common plane. The guns generate three electron beams which pass through the apertures 9 in the colour selection electrode, e.g. a shadow mask 10, at a small angle to each other so that each impinges only on stripe-shaped phosphor regions of one colour. In that case, the tube is adjusted in a colour-pure manner. The colour purity adjustment may be made by colour purity magnets 11. The colour display tube is held in a mounting device by means of a holder, whose parts 12 which clamp the tube are shown in the Figure, in a manner such that the tube can be tilted and moved. Around the neck and/or the funnel-shaped portion of the envelope is mounted a device 13 for producing a dynamic four-pole field in a manner such that the tube can be tilted and moved substantially in a plane normal to the tube axis 14 with respect to the four-pole field. The position of the dot on the display screen is located by means of a matrix 15 of photosensitive elements placed against the display window 4.

The method of the invention is carried out as follows. The central electron gun 7 is energized and the landing spot of the electron beam generated by this gun is adjusted on the display screen by means of the magnet 11 to give the proper colour purity. The magnetic four-pole device 13 is energized with an alternating voltage, e.g. a sawtooth voltage, with the usual deflection frequency so that a dynamic magnetic four-pole field is generated. If the electron beam does not pass through the center of the four-pole device, it will be deflected and produce a curved, visible line on the display screen 5. This can also be established by means of the matrix 15. The four-pole device 13 is now moved with respect to the tube envelope in a plane normal to the tube axis 14 until a dot is obtained on the screen 5. This is again established by the matrix 15 or by means of a monocular. The axis of the electron beam of the central gun is now determined by the position of the dot on the display screen and the center 16 (see FIGS. 3 and 4) of the dynamic four-pole field. The position of the electron beam axis is thus fully determined by the relative positions of the holder 12 and the four-pole device 13, which together fix the position of the center 16, and the position of the dot on the display screen 5 as determined by the matrix 15. This information is applied to a process computer 17 which controls the tool for adjusting the reference surfaces. This may be done, for example, by providing a ring 20 around the funnel-shaped portion 3 or the neck 2 of the tube. The dimensions of the ring are such that the reference points are adjusted by trimming the ring by means of the reshaping tools 18 and 19 which are controlled by the process computer 17. In this case the reference points form the reference faces 21 and 22. Reference face 22 also establishes the position of the deflection unit in the direction of the tube axis 14. Alternatively it is possible to use three cams instead of a ring. The reference points are then adjusted by grinding or adding materials to the cams. It is not essential to use matrix 15. Finding out whether a dot is displayed and the localization may also be done by means of a simple binocular.

Another known possibility for adjusting the reference points is by means of adjusting screws or by gluing spacer plates against the neck 2 and/or the funnel-shaped part 3 of the envelope 1.

The gist of the invention is to locate the position and the direction of the electron beam axis by means of a dynamic magnetic multipole, preferably a four-pole, through the line through the center of the multipole field and the resulting dot on the display screen.

FIG. 2 shows the matrix 15 comprising a large number of photodiodes 23. When a line is displayed on the display screen, light impinges upon several photodiodes. The tube is then moved in the multipole field until light impinges upon only one photodiode. In that case a dot is displayed on the display screen. The photodiode also fixes the position of the dot in the system of axes X-Y.

FIGS. 3 and 4 show two possibilities for generating a dynamic magnetic four-pole field. FIG. 3 shows a toroidal coil construction, the four-pole field being determined by the magnetic field lines 24. The magnetic field is generated by passing an alternating current e.g. a sawtooth current, of a frequency equal to the usual deflecting frequency through the turns 25 of the coils wound around a yoke ring 26. It is also possible to use an alternating current with another frequency e.g. a sinusoidal current of 50 or 60 Hz.

FIG. 4 shows a dynamic four-pole field having radially positioned coils 27. As is known, there are many more possibilities to generate a dynamic magnetic four-pole field. Moreover, the invention is not restricted to a four-pole since a six-pole, eight-pole and so on may also be used successfully. A great advantage of the invention is that, since the reference points define the position and direction of the electron beam axes, the position of deflection units of different types, for example pairs of saddle-shaped coils, toroidal coils or a combination of these two types, can be simply be adjusted on one type of envelope by causing the electron optical axis thereon to coincide with the electron beam axis fixed by the reference points.

What is claimed is:

1. A method of providing a reference point for mounting a magnetic deflection unit onto a display tube having an envelope comprising a neck, a funnel portion and a window portion with a display screen, and at least one electron gun mounted in the neck for generating an electron beam which is incident on the screen, said method comprising the steps of energizing said electron gun to thereby generate said electron beam, producing, in the path of said beam, a dynamic multipole magnetic field in a plane generally normal to the longitudinal axis of the tube, moving one of said tube and said field with respect to the other until said beam produces a dot on said display screen, locating the position of said dot relative to the center of said field to thereby determine the position of the beam axis which is coincident with a line passing through said dot and the center of said field, and providing on said envelope at least one reference surface which is spaced from and defines the position of said line and thereby defines the position of the beam axis.

2. The method according to claim 1 wherein said tube is a color display tube having three electron guns mounted in said neck with the axes thereof lying in a common plane and said step of energizing includes energizing the central electron gun to generate said beam, and including the step of adjusting the position of said beam to provide a color pure display.

3. The method according to claim 1 wherein said field is a four-pole field.

4. A method of providing a reference surface for mounting a magnetic deflection unit of a color display tube having an envelope comprising a neck, a funnel portion and a window portion with a display screen, and three electron guns mounted in the neck with the axes thereof lying in a common plane, each gun generating an electron beam which is incident on said screen, said method comprising the steps of adjusting the position of the center beam generated by the central electron gun to provide a color pure display, producing in the path of said center beam a dynamic multipole magnetic field in a plane generally normal to the longitudinal axis of the tube, moving one of said tube and said field relative to the other until said center beam produces a dot on said screen, locating the position of said dot relative to the center of said field to thereby determine the position of the beam axis which is coincident with a line passing through said dot and the center of said field, and providing on said envelope at least one reference surface which is spaced from and defines the position of said line and thereby defines the position of the axis of said center beam.

5. A method of determining the position of the axis of an electron beam in a display tube having an envelope, an electron gun for generating the electron beam and a display screen located in the path of the beam, said method comprising the steps of energizing said gun to thereby generate said electron beam, producing, in the path of the beam, a dynamic multipole magnetic field in a plane normal to the longitudinal axis of said tube, moving one of said tube and the field relative to the other until said beam produces a dot on said screen, and locating the position of said dot with respect to the center of said field to thereby determine the position of the beam axis which is coincident with a line passing through the center of said field and said dot.

6. An apparatus for providing a reference surface for mounting a magnetic deflection unit on a display tube having an envelope comprising a neck, a funnel portion and a window portion with a display screen, and at least one electron gun mounted in the neck for generating an electron beam which is incident on the screen, said apparatus comprising means for producing, in the path of the beam, a dynamic multipole magnetic field in a plane generally normal to the longitudinal axis of the tube, means for moving one of said tube and said field producing means relative to the other, means for locating the position of a dot produced by said beam on said screen with respect to the center of said field and means for providing on said envelope at least one reference surface which is spaced from and defines the position of a line passing through said dot and the center of said field.

7. The apparatus according to claim 6 wherein said locating means includes a matrix of photosensitive elements positioned in front of said display screen.

8. The apparatus according to claim 6 wherein said field producing means includes a multipole electromagnet mounted about said neck.

9. The apparatus according to claim 8 wherein said magnet, has four-poles and is energized by an alternating current.

* * * * *